US005493620A

United States Patent [19]

Pulfrey

[11] Patent Number: 5,493,620

[45] Date of Patent: Feb. 20, 1996

[54] HIGH FIDELITY SOUND REPRODUCING SYSTEM

[76] Inventor: Robert E. Pulfrey, 307 Glenwood Rd., Bel Air, Md. 21014

[21] Appl. No.: 170,403

[22] Filed: Dec. 20, 1993

[51] Int. Cl.[6] ..... H04R 3/00

[52] U.S. Cl. ..... 381/96

[58] Field of Search ..... 381/96, 89, 57, 381/107, 108, 103

[56] References Cited

U.S. PATENT DOCUMENTS

| | | | |
|---|---|---|---|
| 2,857,461 | 10/1958 | Brodie | 179/1 |
| 2,948,778 | 8/1960 | Clements | 179/1 |
| 3,009,991 | 11/1961 | Bekey | 179/1 |
| 3,014,096 | 12/1961 | Clements | 179/1 |
| 3,047,661 | 7/1962 | Winker | 179/1 |
| 3,118,972 | 1/1964 | Walczak | 179/1 |
| 3,142,724 | 7/1964 | Juvonen | 179/1 |
| 3,334,184 | 8/1967 | Koning | 179/1 |
| 3,530,244 | 9/1970 | Reiffin | 179/1 |
| 3,798,374 | 3/1974 | Meyers | 179/1 F |
| 4,130,725 | 12/1978 | Nagel | 179/1 A |
| 4,201,886 | 5/1980 | Nagel | 179/1 A |
| 4,229,618 | 10/1980 | Gamble | 179/1 F |
| 4,243,839 | 1/1981 | Takahashi et al. | 179/1 F |
| 4,256,923 | 3/1981 | Meyers | 381/96 |
| 4,276,443 | 6/1981 | Meyers | 179/1 F |
| 4,287,389 | 9/1981 | Gamble | 179/1 F |
| 4,340,778 | 7/1982 | Cowans et al. | 179/1 D |
| 4,406,921 | 9/1983 | von Recklinghausen | 179/1 N |
| 4,464,785 | 8/1984 | Kagdis | 381/117 |
| 4,504,704 | 3/1985 | Ohyaba et al. | 179/115.5 DV |
| 4,525,856 | 6/1985 | Admiraal et al. | 381/93 |
| 4,550,430 | 10/1985 | Meyers | 381/96 |
| 4,609,784 | 9/1986 | Miller | 179/115.5 DV |
| 4,649,565 | 3/1987 | Kaizer et al. | 381/90 |
| 4,675,835 | 6/1987 | Pfleiderer | 364/571 |
| 4,747,144 | 5/1988 | Admiraal et al. | 381/93 |
| 4,821,328 | 4/1989 | Drozdowski | 381/96 |
| 4,868,870 | 9/1989 | Schrader | 381/96 |
| 5,086,473 | 2/1992 | Erath | 381/96 |

FOREIGN PATENT DOCUMENTS

| | | | |
|---|---|---|---|
| 0090492 | 5/1984 | Japan | 381/96 |

*Primary Examiner*—Edward L. Coles, Sr.
*Assistant Examiner*—Jerome Grant, II
*Attorney, Agent, or Firm*—Leonard Bloom

[57] ABSTRACT

A high fidelity sound reproducing system includes at least one dynamic speaker having a voice coil operatively driving a diaphragm. A differential power amplifier has an output coupled to the voice coil of the dynamic speaker and a noninverting (+) input connected to an audio signal source for driving the speaker in accordance with an input audio signal. A measuring transducer is associated with the dynamic speaker for generating a first feedback signal proportional to the velocity of the dynamic speaker diaphragm. The measuring transducer may be positioned in front of the speaker, behind the speaker or within the bore of the speaker. An active differentiating signal amplifier has an input coupled to the measuring transducer for differentiating the feedback signal into a second feedback signal proportional to the acceleration of the dynamic speaker diaphragm. The active differentiating signal amplifier further has an output connected to an inverting (−) input of the differential power amplifier for driving the speaker in accordance with the input audio signal and the second feedback signal. The system may include multiple channels, each provided with its respective speaker, differential power amplifier, measuring transducer and active differentiating signal amplifier. The system may be a stereo system having two or more channels.

29 Claims, 9 Drawing Sheets

1.0v.
0.1 v.
LOG. OF VOLTAGE AMPLITUDE
10.0mv.
1.0mv.
0.1mv.
A
10hz.
100hz.
1.0Khz.
10Khz.
100Khz.
LOG. OF FREQUENCY 10v.
1.0v.
B
LOG. OF VOLTAGE AMPLITUDE
100mv.
10mv.
1.0mv.
10hz.
100hz.
1.0Khz.
10Khz.
100Khz.
LOG. OF FREQUENCY 0.7
VOLTAGE AMPLITUDE
0.6
C
0.5
10hz.
100hz.
1.0Khz.
10Khz.
100Khz.
LOG. OF FREQUENCY

HIGH FIDELITY SOUND REPRODUCING SYSTEM

FIELD OF THE INVENTION

This invention relates to sound reproducing systems and, in particular, to a high fidelity sound reproducing system which includes an active differential signal amplifier which produces a feedback signal proportional to the acceleration of the dynamic speaker diaphragm.

BACKGROUND OF THE INVENTION

Several prior art sound reproducing systems have included the loudspeaker in a feedback loop for reducing loudspeaker distortion, and for allowing use of smaller loudspeakers and smaller loudspeaker enclosures. Such prior art systems, especially those which include means for magnetically sensing the axial motion of the associated loudspeaker cone, have considered neither the detrimental effects due to electrical interference from the main electromagnetic loudspeaker structure, nor the proper frequency shaping of the motional feedback signal to cause the loudspeaker to respond linearly to the input source signal. Such prior art sound reproducing systems are cited in U.S. Pat. No. 3,798,374 entitled "Sound Reproducing System Utilizing Motional Feedback" issued on Mar. 19, 1974 to Stanley T. Meyers. This prior art system uses passive RC equalizers and filters which result in phase shifts which vary from near zero at high frequencies to near 90° at low frequencies thereby failing to correct distortion and failing to provide a wide band uniform frequency response.

A more recent sound reproducing system is disclosed in U.S. Pat. No. 4,550,430 entitled "Sound Reproducing System Utilizing Motional Feedback and an Improved Integrated Magnetic Structure" issued Oct. 29, 1985 to Stanley T. Meyers which discloses a sound reproducing system utilizing motional feedback and an integrated magnetic structure for reducing loudspeaker distortion; for reducing acoustic coupling between the radiated sound energy output and the cone motion sensing structure thereby reducing unwanted feedback signals; and for reducing obstruction of the radiated sound energy output by the cone motion structure thereby minimizing alteration of the radiated tonal quality. The loudspeaker includes a cone, a frame, and flexible webs. The main electromagnetic structure includes a rear cylindrical iron pole piece, an annular cylindrical permanent magnet, an inner annular cylindrical iron pole piece, a main voice coil bobbin, a main voice coil, and a front annular cylindrical iron pole piece. The cone motion sensing structure includes a front annular copper disc, a rear cylindrical non-magnetic support member, an annular cylindrical copper sleeve, a cylindrical iron rod, a feedback sensing coil, a feedback sensing coil bobbin, and a feedback sensing coil bobbin support member. The associated circuitry includes a passive stability control network, a passive velocity equalizer, and a passive frequency equalizer which do not provide a wide band uniform frequency response and uniform phase shift. Thus, the system disclosed in the Meyers U.S. Pat. No. 4,550,430 has the same above-noted shortcomings and drawbacks as the system disclosed in the Meyers U.S. Pat. No. 3,798,374.

Early sound reproduction systems of general background interest are disclosed in U.S. Pat. No. 3,530,224 entitled "Motional Feedback Amplifier Systems" issued Sep. 22, 1970 to M. G. Reiffin, U.S. Pat. No. 3,118,972 entitled "Acoustic Apparatus" issued Jan. 21, 1964 to S. Walczak and U.S. Pat. No. 2,948,778 entitled "Sound Reproducing Means" issued Aug. 9, 1960 to W. W. Clements.

SUMMARY OF THE INVENTION

An object of the present invention is to provide a high fidelity sound reproducing system which voids the above-noted limitations and drawbacks of the prior art.

Another object of the present invention is to reduce distortion and provide a flat frequency response over the entire bandwidth in a high fidelity sound reproducing system.

An additional object of the present invention to provide, in a high fidelity sound reproducing system, a feedback signal which represents the velocity of the diaphragm of a speaker, is differentiated and fed to the inverting (–) input terminal of a differential power amplifier.

A further object of the present invention is to provide an improved high fidelity sound system which reduces distortion due to cone motion and which is useful in conjunction with small dynamic speakers as well as in conjunction with large speakers, such as speakers and speaker arrays used in concert halls and the like.

Yet another object of the present invention is to provide a high fidelity sound reproducing system which includes an active differential signal amplifier or signal processing circuit and produces a feedback signal proportional to the acceleration of the dynamic speaker diaphragm which is fed to the differential signal processing circuit and is effective over a wide audio frequency range.

The foregoing objects, as well as others which are to become apparent, are achieved in accordance with the present invention, by providing a high fidelity sound reproducing system which includes a dynamic speaker having a given operating frequency range and has a voice coil operatively driving a diaphragm. A differential power amplifier has an output coupled to the voice coil of the dynamic speaker and a noninverting (+) input connected to an audio signal source for driving the speaker in accordance with an input audio signal. A measuring transducer is associated with the dynamic speaker for generating a first feedback signal proportional to the velocity of the dynamic speaker diaphragm. An active signal processing means, having an input coupled to the measuring transducer phase shifts the feedback signal by substantially 90° (more than 45° and less than 135°) over the operating frequency range and provides a frequency response proportional to frequency thereby providing a processed feedback signal. The active signal processing means has an output coupled to the inverting (–) input of the differential power amplifier for feeding the processed feedback signal thereto thereby establishing the output signal driving the speaker in accordance with the input audio signal and the processed feedback signal from the active signal processing means.

The present invention can also be seen as a high fidelity sound reproducing system which includes a dynamic speaker having a voice coil operatively driving a diaphragm. A differential power amplifier has an output coupled to the voice coil of the dynamic speaker and a noninverting (+) input connected to an audio signal source for driving the speaker in accordance with an input audio signal. A measuring transducer is associated with the dynamic speaker for generating a first feedback signal proportional to the velocity of said dynamic speaker diaphragm. An active differentiating signal amplifier has an input coupled to the measuring transducer for differentiating the first feedback signal into a second feedback signal proportional to the acceleration of the dynamic speaker diaphragm. The active differentiating signal amplifier further has an output connected to the inverting (–) input of the differential power amplifier for feeding the second feedback signal thereto, thereby driving the speaker in accordance with the input audio signal and the second feedback signal.

The active differentiating signal amplifier may be an operational amplifier having a noninverting (+) input connected to ground and an inverting (–) input connected through a capacitor to the measuring transducer. The feedback loop may include a parallel resistance and capacitance connected between the inverting (–) input and output of the active differentiating signal amplifier.

The active differentiating signal amplifier desirably may exhibit a gain versus frequency characteristic which is substantially linear and proportional to frequency over a frequency range from about 10 Hz. to about 40,000 Hz.

The active differentiating signal amplifier imparts a phase shift of substantially 90° to the second feedback signal with respect to the first feedback signal.

The attenuation of the second feedback signal with respect to the differential power amplifier output signal is substantially constant over a frequency range from about 10 Hz. to about 40,000 Hz.

A voltage divider may be connected at the output of the active differentiating signal amplifier to attenuate the second feedback signal so that the level of the second feedback signal applied at the inverting (–) input of the differential power amplifier is substantially the same as the level for the input audio signal applied at the noninverting (+) input of the differential power amplifier over a frequency range from about 10 Hz. to about 40,000 Hz.

A high value resistor may be connected from the output of the differential power amplifier to the inverting (–) input to provide stability for the differential power amplifier.

The closed loop voltage gain of the differential power amplifier measured from the positive input to output is desirably substantially constant over a frequency range from about 10 Hz. to about 40,000 Hz.

The measuring transducer may be positioned in front of the speaker diaphragm, within an axial bore provided within the speaker or in back of the speaker.

It is to be appreciated that the principles of the present invention can be incorporated into multi-speaker systems which effect stereo sound reproductions, surround-sound and concert-hall sound reproduction by using the unique features in at least one and up to all channels in such systems.

BRIEF DESCRIPTION OF THE DRAWINGS

Turning to the detailed description of the preferred embodiments, like reference numerals designating like components in the figures, the features, components, novelties and salient characteristics of applicant's invention are described as shown.

DETAILED DESCRIPTION OF THE PREFERRED EMBODIMENTS

Figure 1:
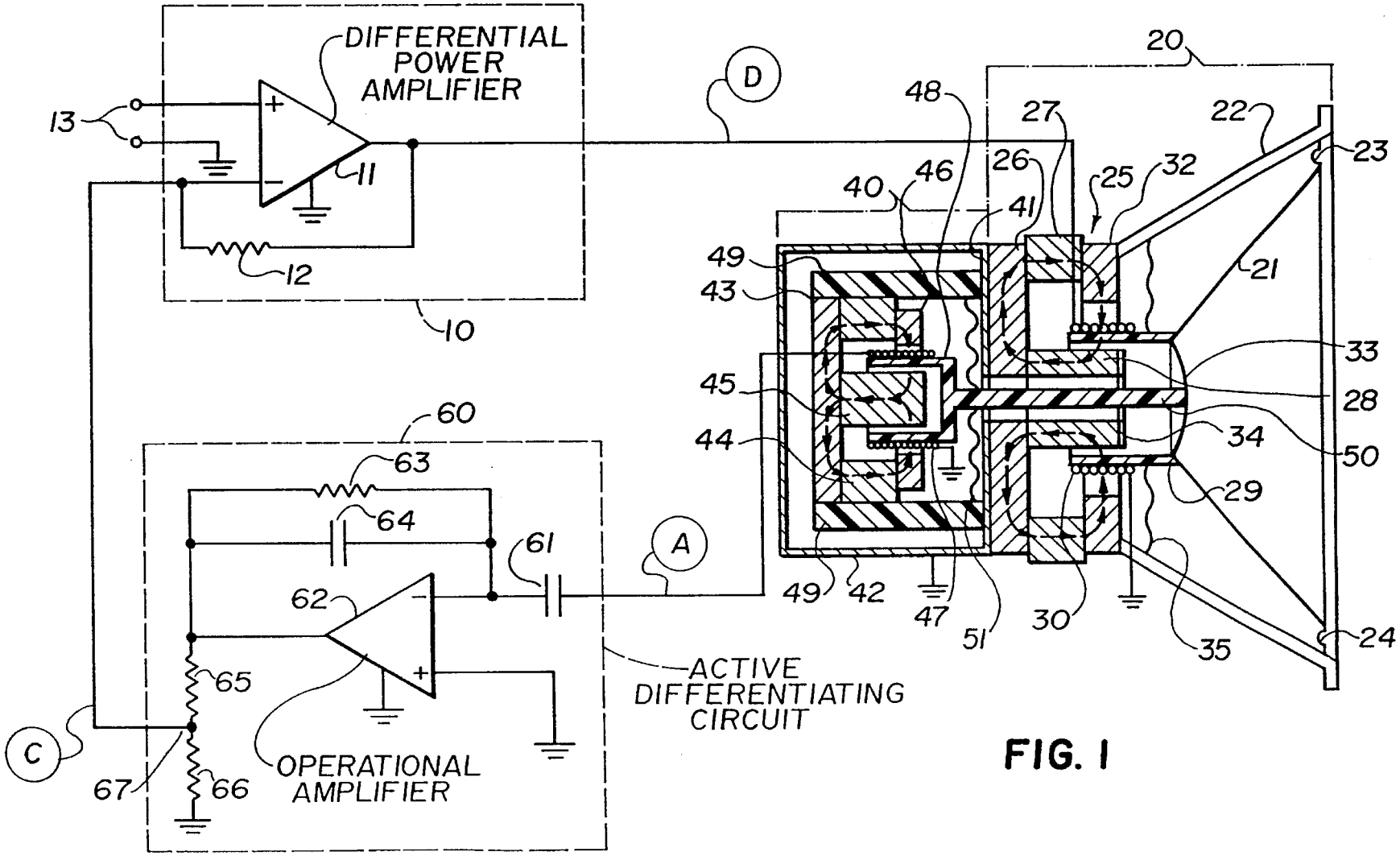
FIG. 1 is a partially schematic diagram of an illustrative first embodiment of a high fidelity sound reproducing system in accordance with the present invention, parts of the dynamic speaker and its associated motion sensing components including a movingly positioned sensing coil being shown in cross-section.

As illustrated in FIG. 1, the first preferred embodiment of a high fidelity sound reproducing system, constructed in accordance with the present invention, includes, in general, four major circuit components. The major circuit components are (1) a signal amplification channel 10, (2) a moving coil-type loudspeaker structure 20, (3) a cone-motion velocity sensing structure 40 which constitutes a measuring transducer, and (4) a signal processing and feedback circuit 60 which includes an active differentiating circuit.

The signal amplification channel 10, as shown, includes a differential power amplifier 11 having a resistor 12 conductively connected between its output terminal on its inverting input terminal, as is conventional to provide a d.c. return. The differential power amplifier 11 is provided with a conventional a.c. ground connection. In realized embodiments the amplifier 11 operated at gains in the range of 10 to 20. The signal to be reproduced is fed from an input signal source (not shown) to a pair of system input terminals 13, one of which is at a.c. ground, the other being connected to the noninverting input of the differential power amplifier 11.

The loudspeaker structure 20 includes a cone 21, a frame or basket 22, webs 23 and 24 and a main electromagnetic structure 25. The main electromagnetic structure 25 includes a rear cylindrical iron pole piece 26, an annular cylindrical permanent magnet 27, an inner annular cylindrical iron pole piece 28 and a thin voice coil nonconductive, nonmagnetic support or bobbin 29. A voice coil 30 is fixedly positioned on the bobbin 29. A front annular cylindrical iron pole piece 32 is positioned about the voice coil 30 and spaced radially therefrom. The voice coil 30 is positioned in the air gap defined between the inner annular pole piece 28 and the front cylindrical pole piece 32, the longitudinal extent of the voice coil 30 is such that the same number of turns is always within the air gap, even at maximum deflections in either direction, a configuration usually referred to as "overhang". The forward end of the voice coil bobbin 29, shown to the right, is fixedly connected to the cone 21 which, as shown, is formed integrally with a conventional dust cover 33. It is to be appreciated that the dust cover 33 could be formed as a separate piece and be supported and positioned adjacent to and in contact with the cone 21 so that it moves in conjunction therewith. A copper disk or plate 34 may be fixed to the forward (right-most) surface of the inner annular pole piece 28 to reduce the effect of stray magnetic fields. A first spider 35 is positioned between the frame or basket 22 and the coil bobbin 29 allowing the bobbin to move axially with minimal opposition from friction produced forces.

The measuring transducer is realized by the cone-velocity sensing structure 40 positioned to the rear of the loudspeaker structure 20. The structure 40 includes a front annular disk or centrally-apertured copper plate 41 which is fixedly attached to the rear major surface of the rear iron pole piece 26 of the loudspeaker structure 20. A grounded, cylindrical, copper shielding can 42, which is closed at one end, is fixedly attached at its open end to the rear surface of the copper plate 41 and, with the plate 41, serves to isolate the magnetic fields of the sensing structure 40 and loudspeaker structure 20 from one another to the extent possible, using electrically conductive eddy current carrying members. The can 42 can be provided with one or more openings (not shown) to allow air to enter and leave the can and thereby prevent moisture from accumulating and condensing therein and to allow the cone 21 to move free, to the extent possible, of compressed air loading.

The magnetic circuit of the velocity sensing structure 40 includes a rear cylindrical iron pole piece 43, an annular cylindrical permanent magnet 44, an inner centrally-located annular cylindrical iron pole piece 45, and a front annular cylindrical iron pole piece 46.

A feedback sensing coil 47 is positioned on and wound about a movable cylindrical nonconductive, nonmagnetic support or bobbin 48 which is positioned within a cylindrical air gap defined by space between the open cylindrical iron pole piece 46 and the solid inner annular cylindrical iron pole piece 45. The number, pitch and position of turns of the sensing coil 47 on the movable bobbin 48 are such that "overhang" is provided at both ends of the sensing coil. That is, a number of turns of the coil 47 extend beyond the air gap on both of its ends so that even with maximum deflection in either axial direction, the same number of coils remain within the air gap at all times.

The magnetic members of the cone-velocity sensing structure 40 are fixedly positioned within the shielding can 42 by a nonmagnetic, nonconducting cylindrical support 49. The support 49 may be made of plastic and is fixed, at its inner end, to the plate 41. The pole piece 43 is fixedly connected, about its periphery, to the inner surface of the support 49.

The movable cylindrical bobbin 48 is closed at one end and fixedly mounted near one end of a nonmagnetic, nonconductive solid cylindrical actuator rod 50 or made integral therewith, as illustrated. The other end of the actuator rod 50 is fixedly connected to the dust cover 33 of the speaker cone 21 so as to be axially moved thereby, resulting in axial movement of the sensing coil 47 within the air gap between the pole pieces 45 and 46.

A second supporting spider 51 is positioned between the support 49 and the actuator rod 50 to support the rod, while allowing easy axial movement thereof.

The operation of main electromagnetic structure 25 and the dimensions, shapes, and configurations of its elements are conventional and accordingly shall not be described in detail herein. Suffice it to say, current flowing in the voice coil 30, as a result of output from the differential power amplifier 11, interacts with the fixed magnetic field in the air gap between the iron pole piece 28 and the iron pole piece 32 to effect axial displacement of the voice coil bobbin 29 resulting in motion of the speaker cone 21 and the production of sound corresponding to audio signals sought to be reproduced.

The cone motion sensing structure 40 derives its own magnetic field independent of the stray magnetic field emanating from main electromagnetic structure 25 to provide a cone-velocity feedback signal to the active differentiating circuit 60 which motional feedback signal is functionally related to the axial velocity of cone 21.

The sensing coil 47 is electrically connected across the active differentiating circuit 60 which includes a capacitor 61 connected to one end of the sensing coil 47, its other end being connected to a.c. ground. The plate of the capacitor 61 not connected to the sensing coil 47 is connected to the inverting terminal of an operational amplifier 62 which has its noninverting input terminal directly connected to a.c. ground. A resistor 63, connected in parallel with a capacitor 64, is connected between the output terminal of the operational amplifier 62 and its inverting input terminal. This resistor-capacitor circuit 63, 64 assures that the circuit will not oscillate, the resistor providing a d.c. return as well.

The output terminal of the operational amplifier 62 is connected to a.c. ground via a voltage divider shown as series connected resistors 65 and 66. The purpose of this voltage divider is to bring the magnitude of the output from the operational amplifier 62 down to an appropriate level for feeding its output to the inverting terminal of the differential power amplifier 11.

The circuit components of the signal amplifying channel 10 and the active differentiating circuit 60, in an exemplary realizable system could be as set out below in Table I.

TABLE I

| | |
|---|---|
| R12-50KΩ | R66-500Ω |
| R63-160KΩ | C61-0.15 μf |
| R65-500Ω | C64-25pf |

The resistance and capacitance values may be adjusted over a wide range to achieve various design goals for system gain and bandwidth, and to accommodate a range of sensitivity of the velocity measuring transducer. The differential power amplifier 11 may be a PA19 commercially available from Apex Microtechnology Corporation and the operational amplifier 62 may be a OP-61, commercially available from Precision Monolithics Inc.

It is to be understood that the relative sizes and shapes of the components of the sensing structure 40 and their respective sizes in relation to components of the loudspeaker structure 20 need not be as illustrated, the relative sizes of the components having been shown larger than necessary for the sake of clarity. It is possible to construct the sensing structure 40 as a whole, as well as the individual components thereof, small as shown, for examples, in FIGS. 3 and 4 which are discussed in detail hereinbelow.

Figure 2:
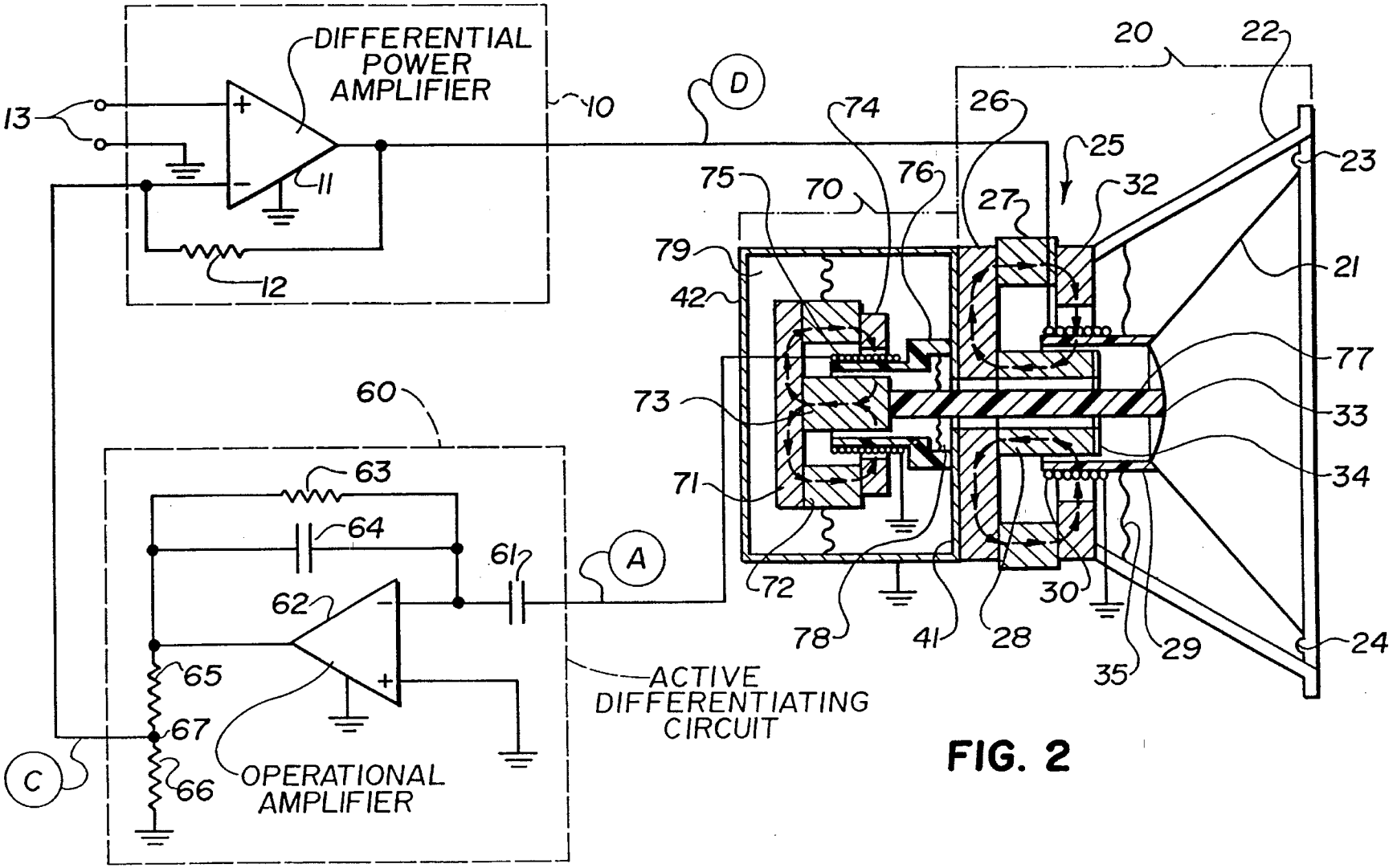
FIG. 2 is a partially schematic diagram of a second illustrative embodiment of a high fidelity sound reproducing system in accordance with the present invention, parts of the dynamic speaker and its associated sensing components including a fixedly positioned motion-sensing coil being shown in cross-section.

As illustrated in FIG. 2, the second preferred embodiment of a high fidelity sound reproducing system, constructed in accordance with the present invention, includes, in general, four major circuit components. The major circuit components are (1) a signal amplification channel 10, (2) a moving coil-type loudspeaker structure 20, (3) a cone-motion velocity sensing structure 70 which constitutes a measuring transducer, and (4) a signal processing and feedback circuit 60 which includes an active differentiating circuit. The signal amplification channel 10, the loudspeaker structure 20 and the active differentiating circuit 60 are identical to and function in the same manner as the components having identical reference numerals as the exemplary high fidelity sound reproducing system illustrated in FIG. 1. Accordingly, a detailed description of these major components in the text is not repeated for the sake of succinctness.

The measuring transducer of the high fidelity sound reproducing system illustrated in FIG. 2 differs principally from the transducer shown in FIG. 1 in that the sensing coil is fixed and the magnetic components are movable. The cone-velocity sensing structure 70 as shown in FIG. 2 is positioned to the rear of the loudspeaker structure 20. The structure 70 includes a front annular disk or centrally-apertured copper plate 41 which is fixedly attached to the rear major surface of the rear iron pole piece 26 of the loudspeaker structure 20. A grounded, cylindrical, copper shielding can 42, which is closed at one end, is fixedly attached at its open end to the rear surface of the plate 41 and with copper plate 41 serves to isolate the magnetic fields of the sensing structure 70 and loudspeaker structure 20 from one another to the extent possible using conductive eddy current shields. The can 42 can be provided with one or more openings (not shown) to allow air to enter and leave the can and thereby prevent moisture from accumulating and condensing therein.

The magnetic circuit of the velocity sensing structure 70 includes a rear cylindrical iron pole piece 71, an annular cylindrical permanent magnet 72, an inner centrally-located annular cylindrical iron pole piece 73, and a front annular cylindrical iron pole piece 74.

A feedback sensing coil 75 is positioned on and wound about a fixedly generally cylindrical support or bobbin 76 and is positioned within a cylindrical air gap defined by space between the open cylindrical pole piece 74 and the solid inner annular cylindrical iron pole piece 73. The bobbin 76 has its end closer to the speaker 20 flared and fixed to the copper plate 41. The number, pitch and position of turns of the sensing coil 75 on the fixed bobbin 76 are such that "overhang" is provided at both ends of the sensing coil. That is, a number of turns of the coil 75 extend beyond the air gap on both of its ends so that even with maximum deflection of its associated magnetic structure in either axial direction, the same number of coils remain within the air gap at all times.

The magnetic members of the cone-velocity sensing structure 70 are movably positioned within the shielding can 42.

The cylindrical iron pole piece 73 is fixedly mounted near one end of a nonmagnetic, nonconductive solid cylindrical actuator rod 77. The other end of the actuator rod 77 is fixedly connected to the dust cover 33 of the speaker cone 21 so as to be axially moved thereby, resulting in axial movement of the magnetic structure consisting of the rear pole piece 71, the magnet 72, the pole piece 74 and the pole piece 73.

A second supporting spider 78 is positioned between the fixed bobbin 76 and the actuator rod 78 to support the rod, while allowing easy axial movement thereof. A third spider 79 may b positioned between the inner cylindrical surface of the can 42 and the rear pole piece 71 to aid in supporting the movable magnetic structure while allowing easy, nearly friction-free axial movement.

The operation of main electromagnetic structure 25 and the dimensions, shapes, and configurations of its elements are conventional and accordingly shall not be described in detail herein. Suffice it to say, current flowing in the voice coil 30 interacts with the fixed magnetic field in the air gap between the iron pole piece 28 and the iron pole piece 32 to effect axial displacement of the voice coil bobbin 29 resulting in motion of the speaker cone 21 and the production of sounds corresponding to audio signals to be reproduced.

The cone motion sensing structure 70 derives its own magnetic field independent of the stray magnetic field emanating from main electromagnetic structure 25 to provide a cone-velocity feedback signal to the active differentiating circuit 60 which motional feedback signal is functionally related to the axial velocity of cone 21.

The sensing coil 75 is electrically connected across the active differentiating circuit 60 which functions in the same position as the differentiating circuit 60 in the system of FIG. 1.

In practicing the present invention, it is desirable to use small, lightweight measuring transducers. It is possible to use small transducers because relatively low levels of measuring currents need to be produced, as compared to the currents driving conventional loudspeaker voice coils. The magnetic fields of the small measuring transducer(s) is (are) not only effectively shielded from the magnetic field(s) of the main speaker magnet(s) and the magnetic field(s) produced by the current in the voice coil(s), but may be produced effectively by high power magnets and a relatively small single E-shaped pole piece appropriated dimensioned to operate in an unsaturated condition. One such small measuring transducer 80 is illustrated in FIG. 3, a second such measuring transducer 100 is shown in FIG. 4.

Figure 3:
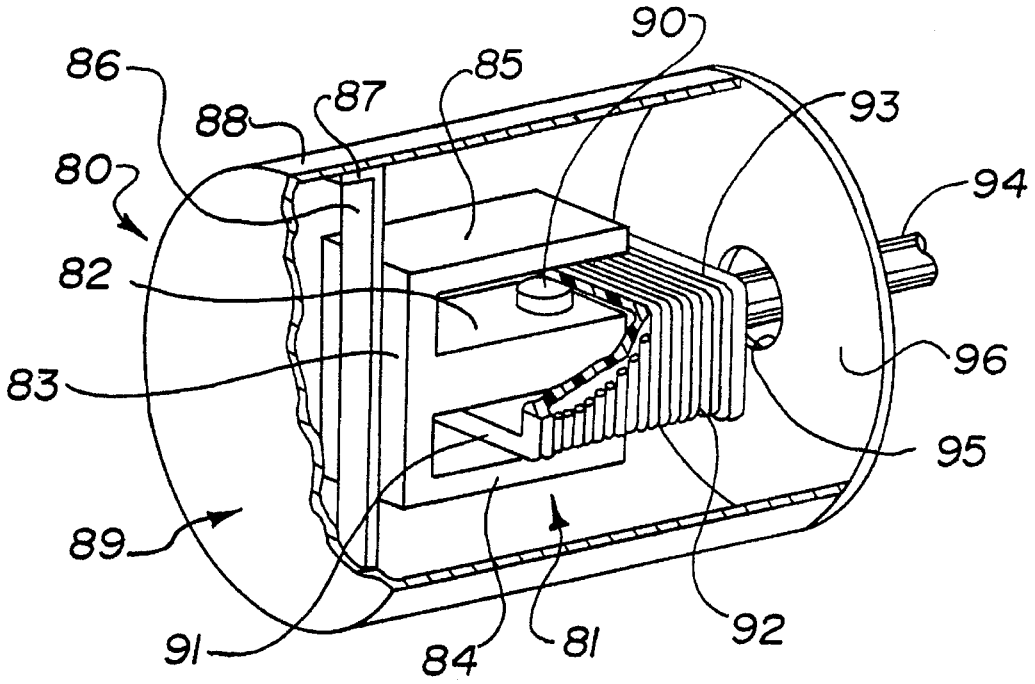
FIG. 3 is a simplified, partially broken away pictorial view of an exemplary measuring transducer which may advantageously used in the present invention and includes fixedly positioned high energy magnets and a movingly positioned sensing coil.
Figure 4:
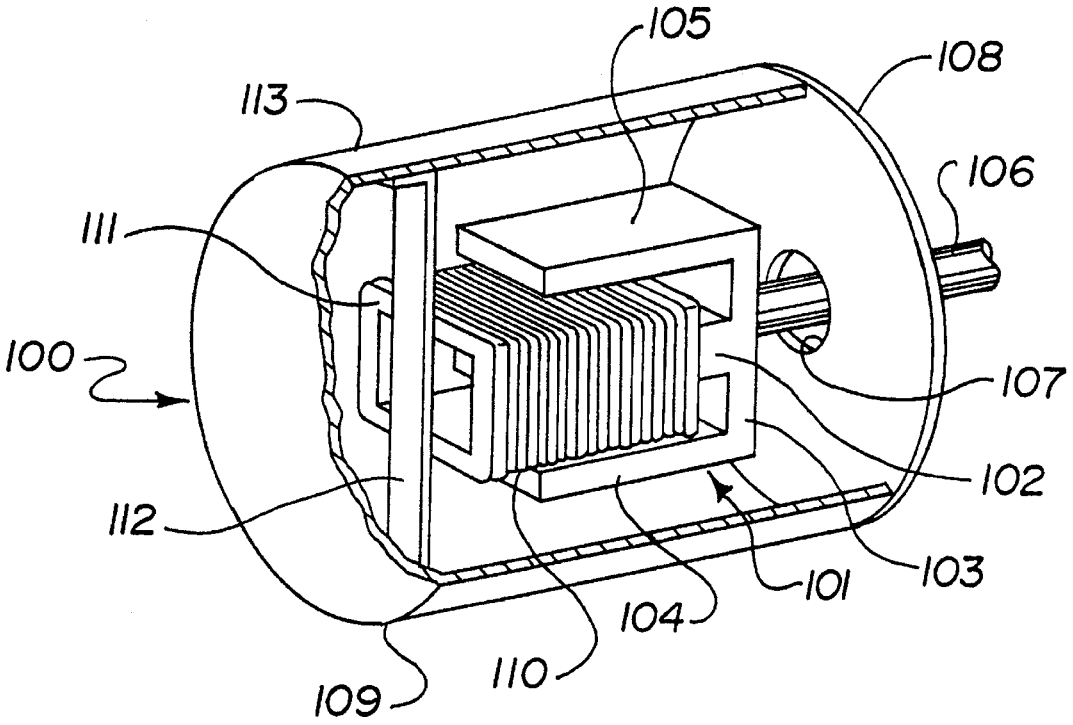
FIG. 4 is a simplified, partially broken away pictorial view of another exemplary measuring transducer which may advantageously used in the present invention and includes a fixedly positioned sensing coil and movingly positioned high energy magnets.

The measuring transducer 80 illustrated in FIG. 3 may be advantageously substituted for the measuring transducer 40 (FIG. 1). The small measuring transducer 80 includes an integral E-shaped pole piece 81 made of iron. A central leg 82 of rectangular cross section and of given thickness, for example ⅛ inch thick, extends from a base leg 83 having two branches extending outwardly from the central leg to respective side legs 84 and 85 which are spaced from and parallel to the central leg. The base leg 83 and the side legs 84 and 85 are of rectangular cross section and of a predetermined thickness, for example 1/16 inch thick.

The base leg 83 of the E-shaped pole piece 81 is fixed by conventional means to an electrically conductive support 86 made, for example of copper. The support 86 is provided with two upstanding ends, one end 87 being visible. The ends of the support 86 are fixed by conventional means, such as solder, to the inner surface of the side wall 88 of a generally cylindrical shielding can 89 which is made of electrically conductive material such as copper and closed at one end. A pair of high energy disk-shaped magnets are positioned and fixed on opposite flat surfaces of the central leg 82 with their respective North poles facing outwardly toward the inwardly facing flat surfaces of the respective outer legs 84 and 85, only one of the magnets 90 being visible in FIG. 3. The magnets 90 are in axial alignment with one another and may be advantageously made of samarium-cobalt 217 or the like.

A movable hollow coil support or bobbin 91 made of plastic and of square or rectangular longitudinal cross section is positioned with two of its parallel walls positioned respectively between the respective side legs 84, 85 and the central leg 86 of the pole piece 81, two side walls of the bobbin have been broken away so that one of the disk magnets 90 can be seen.

Figure 5:
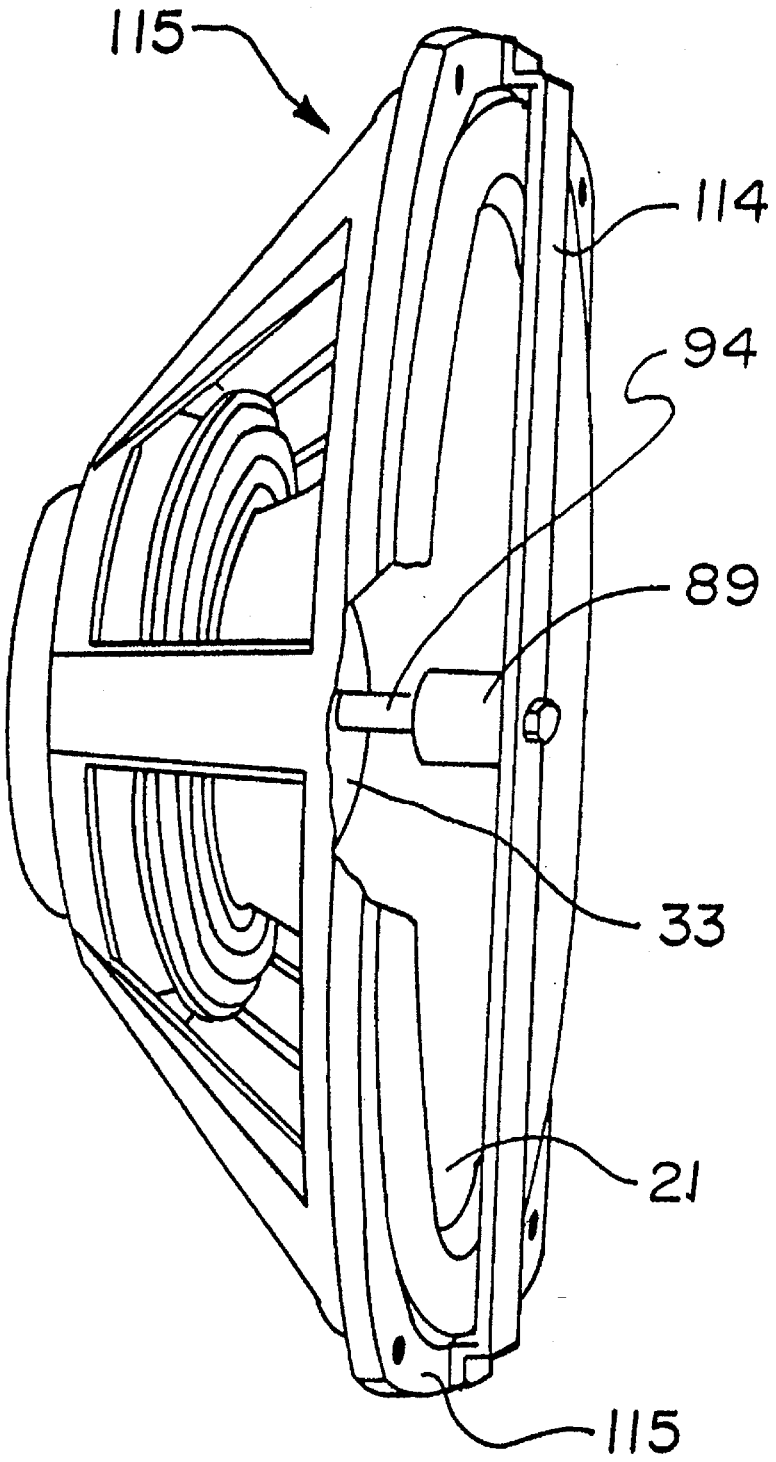
FIG. 5 is a simplified, pictorial view of a speaker illustrating the positioning of its associated measuring transducer in front of the speaker.
Figure 6:
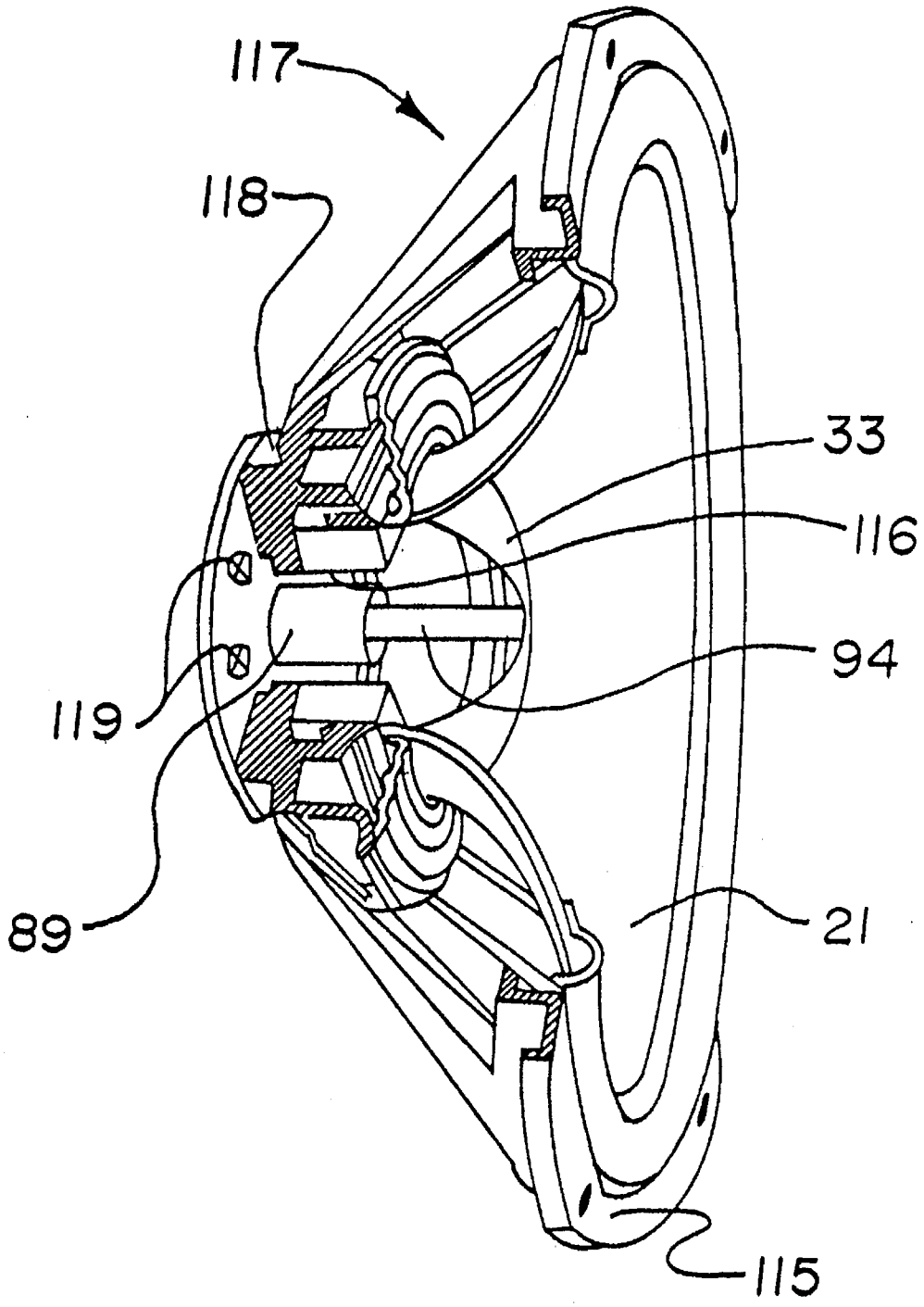
FIG. 6 is a simplified, pictorial view of a speaker illustrating the positioning of its associated measuring transducer within an axial bore provided in the speaker.
Figure 7:
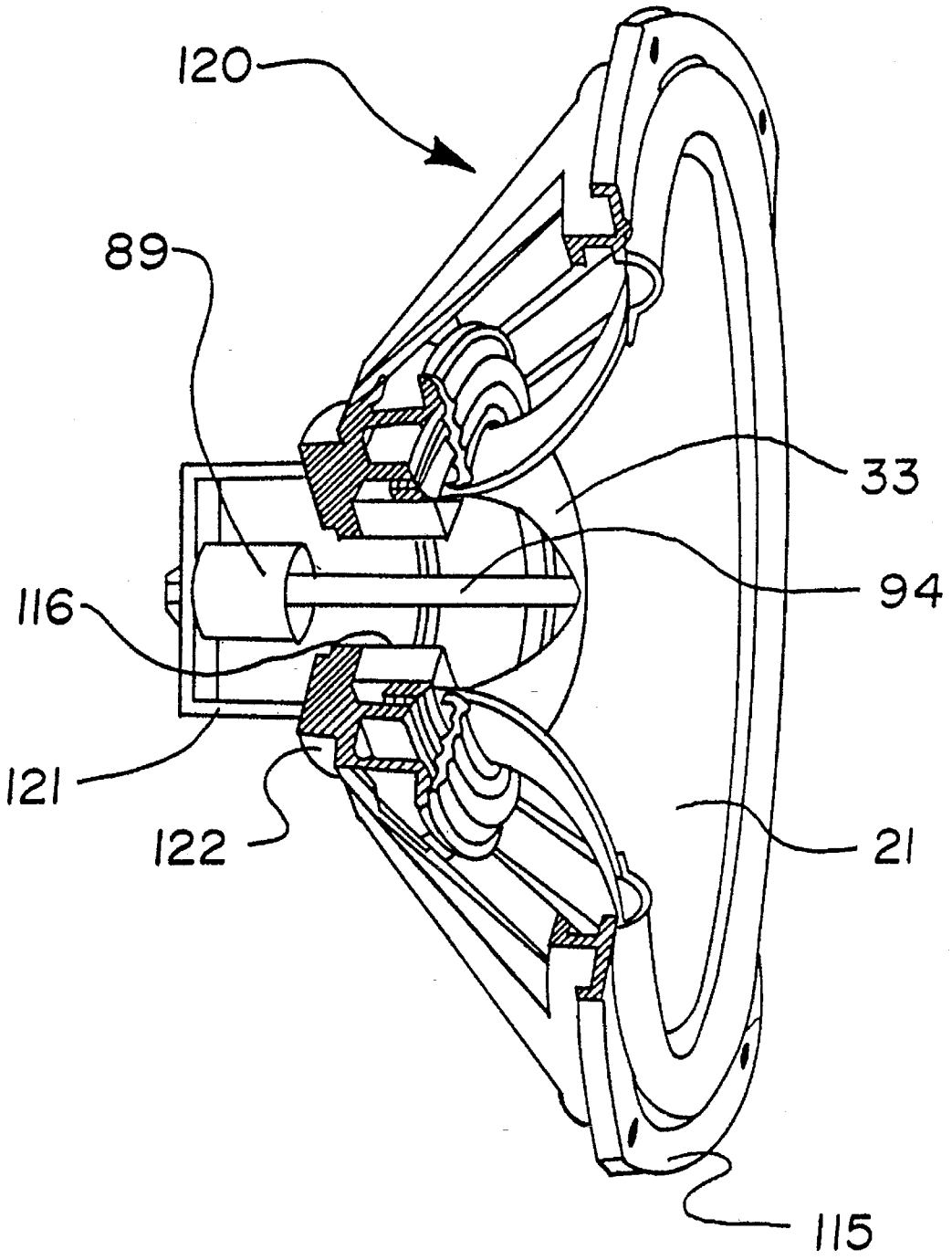
FIG. 7 is a simplified, pictorial view of a speaker illustrating the positioning of its associated measuring transducer to the rear (in back of) of the speaker.

A multiturn sensing coil 92, which corresponds to the sensing coil 47 (FIG. 1), is wound on the bobbin 91. The lower end of the bobbin 91, as viewed in FIG. 3, is closed by an integrally formed base 93. An actuator rod 94 has one end fixed to the base 93, its other end (not visible in FIG. 3) is fixed to the dust cover 33, as illustrated in FIGS. 5, 6 and 7 to which further reference is to be made below.

The actuator rod 94 passes through a small aperture 95 formed centrally in a copper disk 96 which is fixed by solder or the like to the open end of the hollow cylindrical can 89 to provide further eddy current shielding. The turns of the winding 92 are positioned so that the same number of turns is always present in the magnetic flux within the respective air gaps formed between the central leg 82 and the respective legs 84, 85 of the E-shaped pole piece 81 without regard to the extent of the axial movement of the bobbin 91 by the actuator 94, a design feature often referred to as "overhang" as noted above. For the sake of better signal fidelity, some of the turns of the sensing coil 92 toward the open end of E-shaped pole piece 81 are always within the stray magnetic flux between the open ends of the legs 82, 84 and 85. One end (not shown) of the sensing coil 92 is conductively connected to a.c. circuit ground, the other end (not shown) is coupled via a conductive path to an active differentiating circuit, corresponding to the circuit 60 (FIG. 1).

The measuring transducer 100 illustrated in FIG. 4 may be substituted for the measuring transducer 70 shown in FIG. 2. The small measuring transducer 100, similarly to the measuring transducer 80 (FIG. 3) is provided with an integral E-shaped pole piece 101 having a central leg 102, an end or base leg 103 and two side legs 104 and 105. The E-shaped pole piece 101 corresponds to the E-shaped pole piece 81 (FIG. 3); however, it is inverted and is axially movable. The base leg 103 is fixed to one end of an actuator rod 106 made of nonconductive material such as plastic, the rod extending through a central aperture 107 in an electrically conductive circular disk 108 made of copper or the like. The other end of the actuator rod 106 is fixed to the dust cover 33, as illustrated in FIGS. 5, 6, and 7 to which further reference is to be made below.

The circular disk 108 is fixed, by soldering or the like to the open end of a cylindrical shielding can 109 made of conductive material such as copper or the like. A fixedly positioned sensing coil 110 is wound about a fixed coil support 111 so that turns of the coil are positioned within respective air gaps defined between the central leg 102 and respective ones of the legs 104 and 105. A pair of high energy magnets (not visible in FIG. 4) are fixedly positioned on the major surfaces of the central leg 103 facing the respective inwardly facing major surfaces of the legs 104 and 105 with the North poles facing outwardly. The positioning and alignment of the magnets, relative to the sensing coil 110, is as shown in FIG. 3 in relation to coil 92.

The coil support 111 is fixed to a metal support 112 which has two upstanding ends which are fixed, by solder or the like, to the inner surface of the wall 113 of the cylindrical shielding can 109 near its closed end. The coil support 111 could alternatively be directly fixed to the inner surface of closed end wall of the shielding can 109. Like the sensing coil 92 (FIG. 3) of the transducer 80 (FIG. 3), the turns of the sensing coil 110 are of sufficient number and are positioned so as to provide "overhang" to assure that the same number of turns are always within the magnetic fields during the full operating range of relative axial movement between the sensing coil 110 and the magnetic fields, including in preferred form stray fields between the open ends of the legs of the E-shaped pole piece 101.

One end of the sensing coil 110 is to be placed at a.c. ground, as is the sensing coil 73 (FIG. 2) while the other is to be coupled to the input of an active differentiating circuit corresponding to the circuit 60 of FIGS. 1 and 2, as is the other end of the sensing coil 73 (FIG. 2).

The small transducers illustrated in FIGS. 3 and 4 may be mounted in front of a speaker cone 21 as illustrated in FIG. 5. This configuration may be achieved by bolting the closed end of the shielding can 89 (FIG. 3) or the shielding can 109 (FIG. 4) to a support bar 114 which it is welded or bolted to a rim 115 of a speaker, such as the woofer 115. The actuator rod 94 (FIG. 3) or rod 106 (FIG. 4) is fired to the center point of the forward facing surface of the dust cover 33 which, like the dust covers of the speakers shown in FIGS. 1 and 2 is made integral with the speaker cone 21.

In cases when the relative sizes of the small transducers and the conventional axial bores within the speakers are such that the transducers can be positioned within the bore, the shielding can 89 (FIG. 3) or 109 (FIG. 4) may be positioned with an axial bore 116 of the speaker, illustrated generally as a woofer 117, with its closed end conventionally fixed, by a bolt (not visible) to a support plate 118. The actuator rod 94 (FIG. 3) or 106 (FIG. 4) is positioned between the center point of the inner surface of the dust cover 33 and the movable components within the shielding can 89 (FIG. 3) or can 109 (FIG. 4). As in the embodiments shown in FIGS. 1 and 2 the dust cover 33 is integral with the speaker cone 21; thus, axial movements of the cone 21 and dust cover 33 are translated by the rod 94 (FIG. 3) or 106 (FIG. 4). The support plate 118 is provided with a plurality of apertures 119 to prevent moisture from collecting within the bore 116 and to allow ingress and egress of air from the bore during motion of the cone 21 and avoid damping.

The small transducers illustrated in FIGS. 3 and 4 may be mounted in back of the speaker shown generally as a woofer 120 in FIG. 7. In this case, a U-shaped mounting bracket 121 is fixed to the rear annular frame member 122, the cylindrical shielding can 89 (FIG. 3) or 109 (FIG. 4) having its closed end bolted to the U-shaped mounting bracket. The actuator rod 94 (FIG. 3) or 106 (FIG. 4) has its free end fixed to the center point of inner surface of the dust cover 33, its other end being connected to the movable components within the shielding can 89 (FIG. 3) or 109 (FIG. 4). In operation, axial movement of the cone 21, and its integrally formed dust cover 33 of the woofer 120 is translated, via the rod 94 (FIG. 3) or 106 (FIG. 4) into corresponding axial movement of the movable components within the shielding can 89 (FIG. 3) or 109 (FIG. 4), as the cases may be.

In operation, the preferred high fidelity sound reproducing systems illustrated in FIGS. 1 and 2 operate in similar fashion. In both cases the audio signal which is to be reproduced is received at input terminals 13 from a recorded source (such as a CD), a radio source (such as a tuner), microphones (such as a live performance) or the like. The audio signals may, as in the examples, be in a band of from about 10 Hz. to about 40,000 Hz. The signals fed to the terminals 13 are amplified by the differential power amplifier 11, which also receives a feedback signal from the operational amplifier 62 at its inverting input terminal. The output from the differential power amplifier 11 is supplied to the voice coil 30, causing axial movement of the voice coil bobbin 29 in its associated air gap and movement of the cone 21 of the loudspeaker 20 resulting in the reproduction of the sound.

Figure 8:
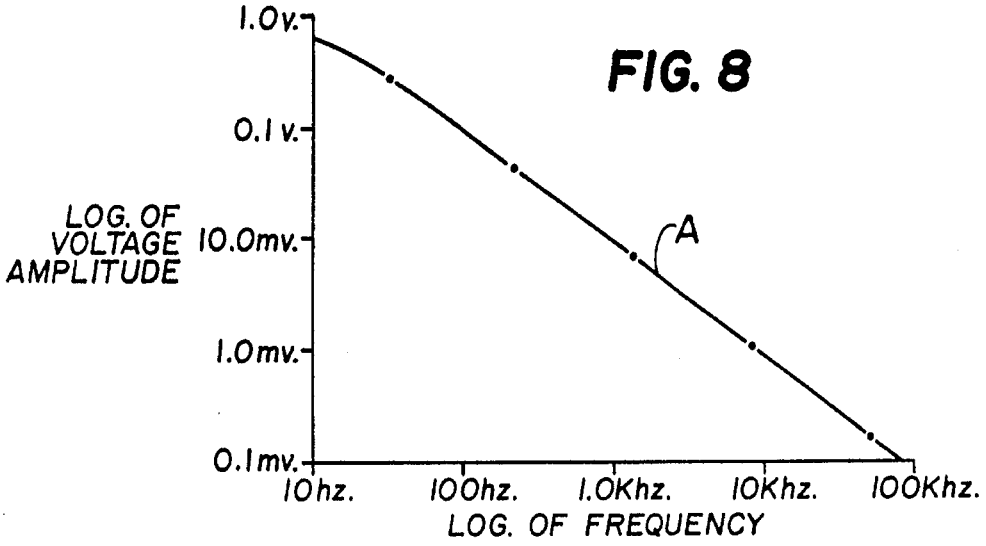
FIG. 8 is a graphic representation of the voltage amplitude versus frequency characteristic of the measuring transducer (respective sensing coils) used in the illustrative embodiments of the high fidelity sound reproducing systems shown in FIG. 1, FIG. 2, FIG. 3 and FIG. 4.

The motion of the cone 21 is translated into axial motion of the actuator rod 50 (FIG. 1) or 77 (FIG. 2) with the resulting axial movement of sensing coil bobbin 48 (FIG. 1) and the velocity sensing coil 47 (FIG. 1) or axial movement of the magnetic structure defined by the magnet 72 (FIG. 2) and pole pieces 71, 73 and 74 (FIG. 2) relative to the fixed air gap between the pole pieces 49 and 41 (FIG. 1) or the pole pieces 73 and 74 (FIG. 2). As a result of the relative motion of the sensing coil 47 (FIG. 1) or the sensing coil 75 (FIG. 2) in the fixed flux within the air the respective air gaps, an electrical signal is generated within the sensing coil 47 (FIG. 1) or the sensing coil 75 (FIG. 2), which corresponds to the velocity of the cone 21, appears at circuit point Ⓐ (FIGS. 1 and 2). The characteristic of the log of the generated voltage amplitude vs. the log of the frequency of the coil motion sensing structure 40 (FIG. 1) or 70 (FIG. 2) within the band under consideration is illustrated in FIG. 8, the characteristic curve A having been derived by a computer-generated simulation.

Figure 9:
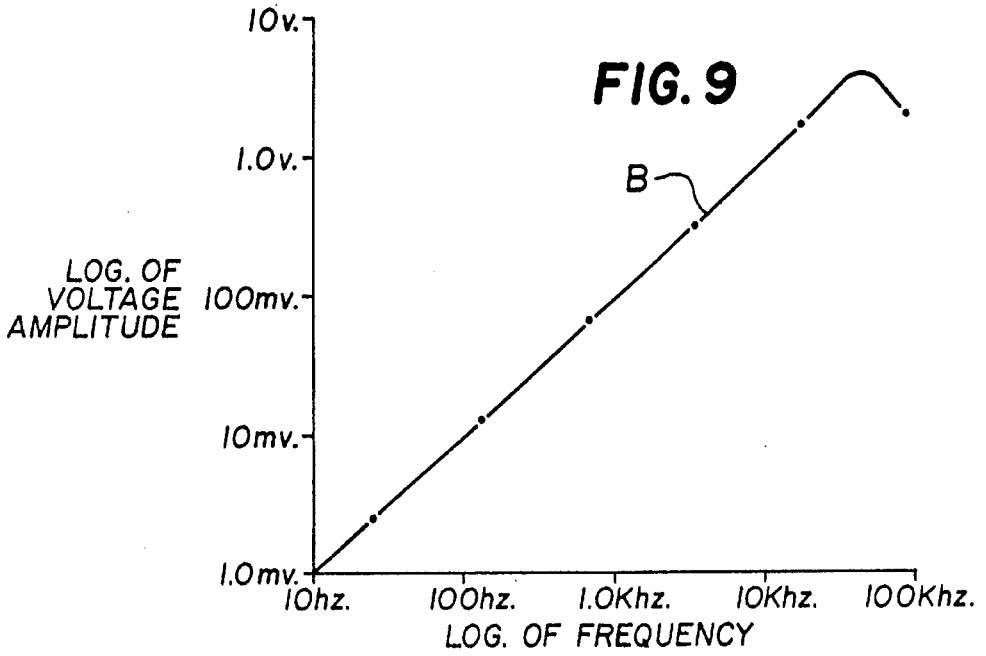
FIG. 9 is a graphic representation of the voltage versus frequency characteristic of active differentiating circuit used in the illustrative embodiments of the high fidelity sound reproducing systems shown in FIG. 1 and FIG. 2.
Figure 10:
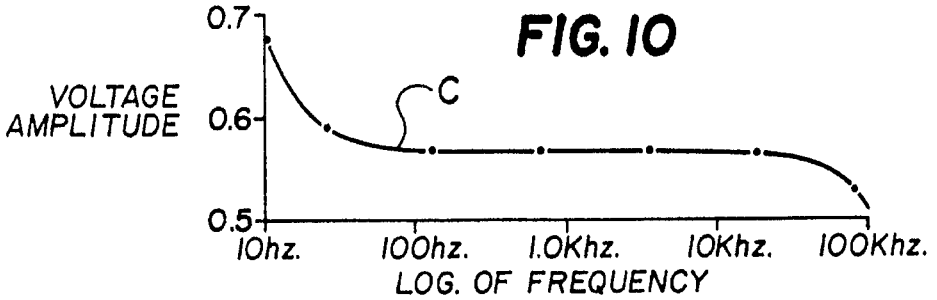
FIG. 10 is a graphic representation of the voltage versus frequency characteristic of the combined measuring transducer (respective sensing coils) and active differentiating circuit used in the illustrative embodiments of the high fidelity sound reproducing systems shown in FIG. 1 and FIG. 2.
Figure 11:
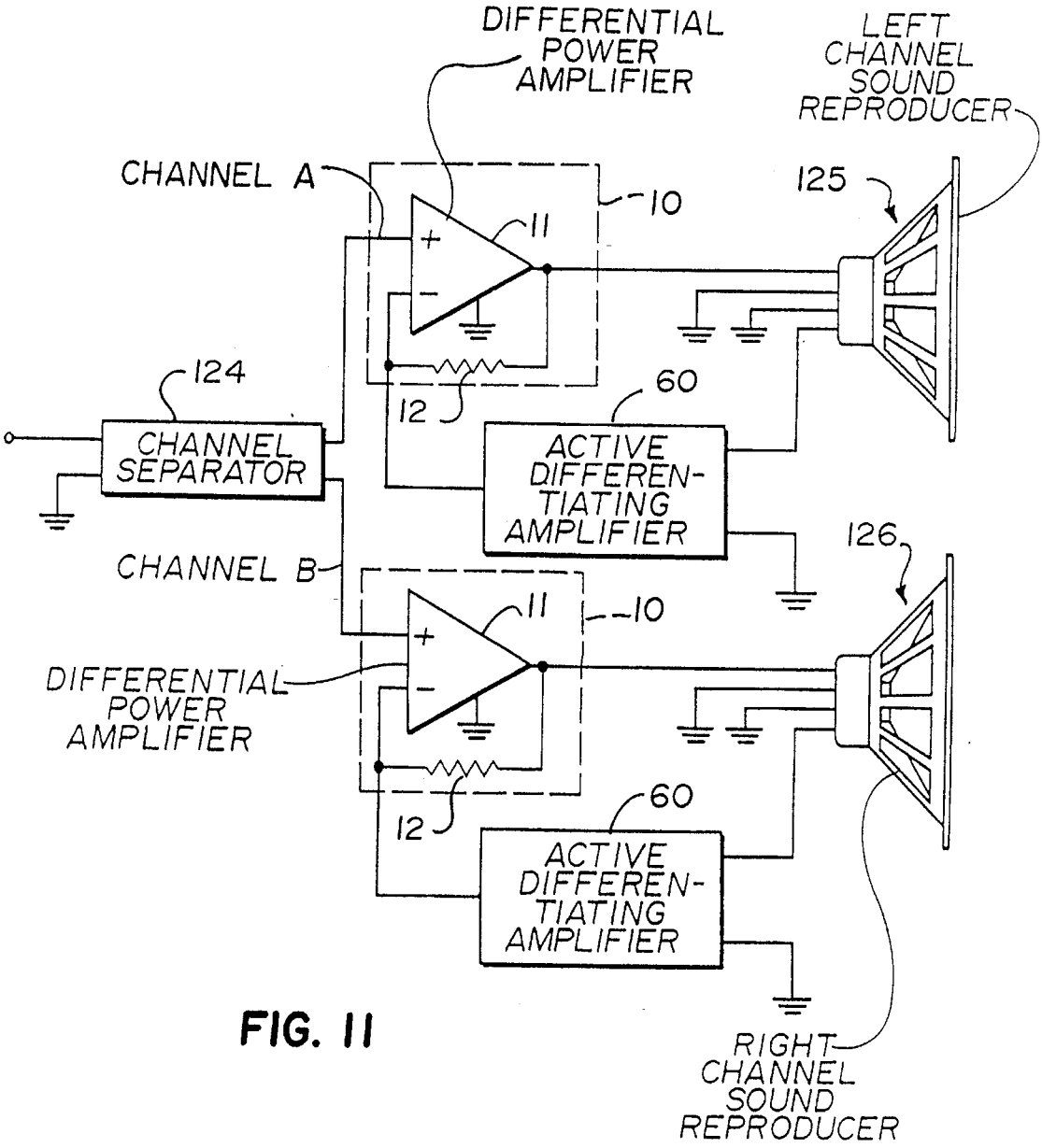
FIG. 11 is a simplified block diagram of a stereo sound reproducing system into each channel of which the present invention has incorporated.
Figure 12:
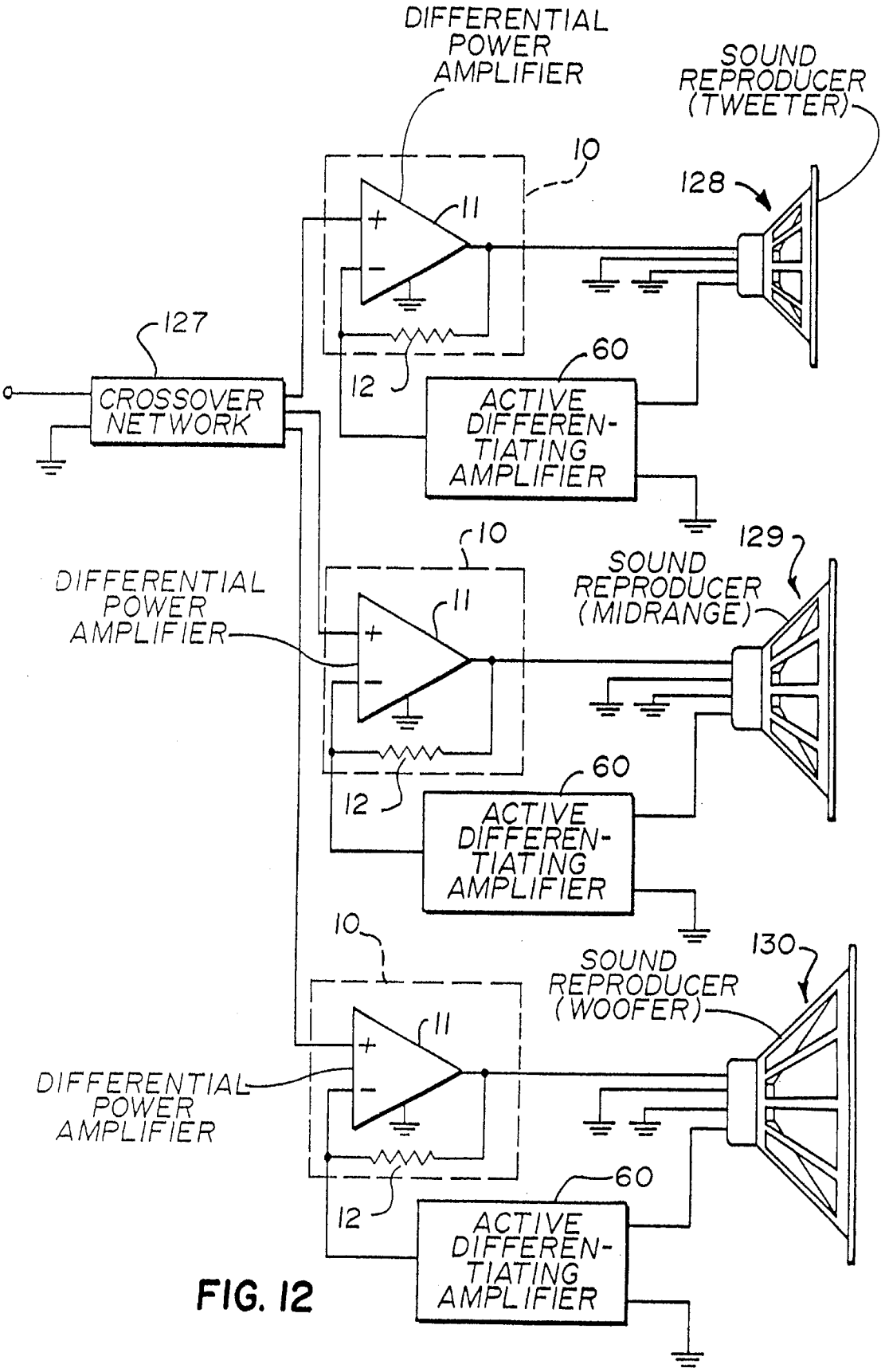
FIG. 12 is a simplified block diagram of a multi-speaker sound reproducing system, including a woofer, a midrange speaker and a tweeter, into which the present invention has been incorporated.

The cone-velocity representing output from the sensing coil 47 (FIG. 1) or sensing coil 75 (FIG. 2) is fed to the active differentiating circuit 60, and is differentiated by action of the capacitor 61, resistor 63 and the operational amplifier 62. The differentiated output from the active differentiating circuit 60, shifts the signal received from the sensing coil 47 (FIG. 1) or 75 (FIG. 2) by substantially 90° over the entire operating frequency range of the signal channel or, preferably in multichannel systems such as illustrated in FIGS. 11 and 12, over the entire operating range. The thus processed feedback signal which represents cone-acceleration (both negative and positive) is supplied from the output of the operational amplifier 62 to a voltage divider composed of the series connected resistors 65 and 66. The voltage divider reduces the amplitude of the resulting feedback signal representing cone-acceleration to a level appropriate at circuit point Ⓒ (FIGS. 1 and 2) for application to the inverting input of the differential power amplifier 11. The characteristic of the log of the voltage amplitude vs. the log of the frequency of the active differentiating circuit 60 within the band under consideration is illustrated in FIG. 9, the characteristic curve B having been derived by a computer-generated simulation. A graphic representation of the voltage amplitude vs. log of frequency of the combined measuring sensing coil 47 (FIG. 1) or 75 (FIG. 2) and the active differentiating circuit 60 is shown in FIG. 10, the curve C therein having been derived by a computer-generated simulation.

The signals to be reproduced received at the terminals 13, as amplified and modified in the differential power amplifier 11 in accordance with the negative feedback signal received at its inverting input from the differentiating circuit 60 constitutes the signals at circuit point Ⓓ (FIG. 1 or FIG. 2) fed the loudspeaker 20. The signals at circuit point Ⓓ have substantially uniform frequency response from about 10 Hz. to about 40 KHz.

The principles of the present invention may be applied to multichannel and/or multispeaker high fidelity sound reproducing systems, such as the stereo sound reproducing system illustrated in FIG. 11 and the multispeaker system illustrated in FIG. 12.

The high fidelity sound reproducing stereo system of FIG. 11 includes a conventional channel separator 124 which separates channel A (left) and channel B (right) signals from one another, the single input to the channel separator being of any accepted format for stereo recording reproduction and/or broadcast reproduction in current use. The channel A and channel B audio signals are supplied to respective signal amplification channels 10 and, as modified by respective negative feedback from respective active differentiating amplifiers 60, to respective speakers 125 and 126. Each of the speakers 125 and 126 includes a respective cone-motion velocity sensing structure including respective feedback sensing coils (not shown in FIG. 11) as illustrated in FIGS. 1–4 or the like. The respective outputs from the respective sensing coils are fed to the respective differentiating amplifiers 60. The operation of the respective signal amplification channels 10 shown in FIG. 11 and respective active differentiating circuits 60 shown in FIG. 11 is not described in more detail here for the sake of succinctness, inasmuch as these circuit components operate in exactly the same manner as do the components of FIGS. 1 and 2 having the same numerals, and which are described above both as to structure and function.

The multispeaker high fidelity sound reproducing system as illustrated in FIG. 12 includes a high frequency tweeter 128, a midrange sound reproducer 129 and a woofer 130. The system is provided with a conventional crossover network 127 which separates the audio input signal fed to the system into three frequency ranges, as is conventional. The respective three signal outputs from the crossover network 127 are fed to respective signal amplification channels 10, each of which corresponds in function and structure to the amplification channels 10 described above in conjunction with FIGS. 1 and 2. Each of the three channels includes a respective differential power amplifier 11 which has its inverting input terminal coupled to a respective output from a respective active differentiating amplifier 60. The respective input signals to the respective active differentiating amplifiers 60 are provided from respective sensing coils (not shown) associated respectively with the tweeter 128, the midrange sound reproducer 129 and the woofer 130. The sensing coils may be constructed and arranged in relation to their associated magnetic and magnetizable components as are the sensing coils shown in FIGS. 1–4 or the like. The operation of the respective amplification channels 10 shown in FIG. 12 and the respective differentiating circuits 60 shown in FIG. 12 are not described in more detail at this point for the sake of succinctness, inasmuch as these circuit components operate in exactly the same manner as those circuits components shown in FIGS. 1 and 2 and which are described above, both as to structure and function, in conjunction with FIGS. 1 and 2.

In use, the present invention reduces loudspeaker distortion over the entire operating bandwidth and provides substantially uniform frequency response. The system uses a cone velocity measuring transducer and an active differentiating signal amplifier within the feedback loop of a differential power amplifier that drives the loudspeaker. This arrangement provides a feedback signal to the inverting (–) terminal of the differential power amplifier that is substantially in-phase and at the same level as the original signal input to the noninverting (+) terminal of the differential power amplifier over the entire frequency range. Therefore, gain of the differential power amplifier is substantially constant over the entire frequency range, and distortion of the loudspeaker is greatly reduced.

It is to be appreciated, that the foregoing description and accompanying illustrations have been set out by way of example, not by way of limitation. Numerous variants and other embodiments are possible without departing from the spirit and scope of the invention, its scope being defined in the appended claims.

What is claimed is:

1. A high fidelity sound reproducing system comprising:

a dynamic speaker having a given operating frequency range and including a voice coil operatively driving a diaphragm;

a differential power amplifier having an output coupled to the voice coil of said dynamic speaker and a noninverting input connected to an audio signal source for driving said speaker in accordance with an input audio signal;

a measuring transducer associated with said dynamic speaker for generating a first feedback signal proportional to velocity of said dynamic speaker diaphragm; and an active differentiating signal amplifier having an input coupled to said measuring transducer for differentiating the first feedback signal over at least the operating frequency range into a second feedback signal proportional to acceleration of said dynamic speaker diaphragm, said active differential signal amplifier further having an output coupled to an inverting input of said differential power amplifier for feeding the second feedback signal thereto, thereby driving said speaker in accordance with the input audio signal and the second feedback signal, wherein said active differentiating signal amplifier includes an operational amplifier having a noninverting input connected to ground, a filter capacitor, an inverting input of said operational amplifier being connected through said capacitor to said measuring transducer, and a feedback loop including a parallel resistance and capacitance connected between said inverting input and output of said active signal differential amplifier.

2. A high fidelity sound reproducing system comprising:

a dynamic speaker having a given operating frequency range and including a voice coil operatively driving a diaphragm;

a differential power amplifier having an output coupled to the voice coil of said dynamic speaker and a noninverting input connected to an audio signal source for driving said speaker in accordance with an input audio signal;

a measuring transducer associated with said dynamic speaker for generating a first feedback signal proportional to velocity of said dynamic speaker diaphragm; and an active differentiating signal amplifier having an input coupled to said measuring transducer for differentiating the first feedback signal over at least the operating frequency range into a second feedback signal proportional to acceleration of said dynamic speaker diaphragm, said active differential signal amplifier further having an output coupled to an inverting input of said differential power amplifier for feeding the second feedback signal thereto, thereby driving said speaker in accordance with the input audio signal and the second feedback signal, wherein said active differentiating signal amplifier exhibits a gain versus frequency characteristic which is substantially linear and proportional to frequency over a frequency range from about 10 Hz. to about 40,000 Hz.

3. A high fidelity sound reproducing system comprising:

a dynamic speaker having a given operating frequency range and including a voice coil operatively driving a diaphragm;

a differential power amplifier having an output coupled to the voice coil of said dynamic speaker and a noninverting input connected to an audio signal source for driving said speaker in accordance with an input audio signal;

a measuring transducer associated with said dynamic speaker for generating a first feedback signal proportional to velocity of said dynamic speaker diaphragm; and an active differentiating signal amplifier having an input coupled to said measuring transducer for differentiating the first feedback signal over at least the operating frequency range into a second feedback signal proportional to acceleration of said dynamic speaker diaphragm, said active differential signal amplifier further having an output coupled to an inverting input of said differential power amplifier for feeding the second feedback signal thereto, thereby driving said speaker in accordance with the input audio signal and the second feedback signal, wherein said active differentiating signal amplifier imparts a phase shift of substantially 90° to the second feedback signal with respect to the first feedback signal.

4. A high fidelity sound reproducing system comprising:

a dynamic speaker having a given operating frequency range and including a voice coil operatively driving a diaphragm;

a differential power amplifier having an output coupled to the voice coil of said dynamic speaker and a noninverting input connected to an audio signal source for driving said speaker in accordance with an input audio signal;

a measuring transducer associated with said dynamic speaker for generating a first feedback signal proportional to velocity of said dynamic speaker diaphragm; and an active differentiating signal amplifier having an input coupled to said measuring transducer for differentiating the first feedback signal over at least the operating frequency range into a second feedback signal proportional to acceleration of said dynamic speaker diaphragm, said active differential signal amplifier further having an output coupled to an inverting input of said differential power amplifier for feeding the second feedback signal thereto, thereby driving said speaker in accordance with the input audio signal and the second feedback signal, wherein attenuation of the second feedback signal with respect to said differential power amplifier output signal is substantially constant over a frequency range from about 10 Hz. to about 40,000 Hz.

5. A high fidelity sound reproducing system comprising:

a dynamic speaker having a given operating frequency range and including a voice coil operatively driving a diaphragm;

a differential power amplifier having an output coupled to the voice coil of said dynamic speaker and a noninverting input connected to an audio signal source for driving said speaker in accordance with an input audio signal;

a measuring transducer associated with said dynamic speaker for generating a first feedback signal proportional to velocity of said dynamic speaker diaphragm; and an active differentiating signal amplifier having an input coupled to said measuring transducer for differentiating the first feedback signal over at least the operating frequency range into a second feedback signal proportional to acceleration of said dynamic speaker diaphragm, said active differential signal amplifier further having an output coupled to an inverting input of said differential power amplifier for feeding the second feedback signal thereto, thereby driving said speaker in accordance with the input audio signal and the second feedback signal, including a voltage divider connected at the output of said active differentiating signal amplifier to attenuate the second feedback signal so that the level of the second feedback signal applied at the inverting input of said differential power amplifier is substantially the same as the level for the input audio signal applied at the noninverting input of said differential power amplifier over a frequency range from about 10 Hz. to about 40,000 Hz.

6. A high fidelity sound reproducing system comprising:

a dynamic speaker having a given operating frequency range and including a voice coil operatively driving a diaphragm;

a differential power amplifier having an output coupled to the voice coil of said dynamic speaker and a noninverting input connected to an audio signal source for driving said speaker in accordance with an input audio signal;

a measuring transducer associated with said dynamic speaker for generating a first feedback signal proportional to velocity of said dynamic speaker diaphragm; and an active differentiating signal amplifier having an input coupled to said measuring transducer for differentiating the first feedback signal over at least the operating frequency range into a second feedback signal proportion to acceleration of said dynamic speaker diaphragm, said active differential signal amplifier further having an output coupled to an inverting input of said differential power amplifier for feeding the second feedback signal thereto, thereby driving said speaker in accordance with the input audio signal and the second feedback signal, including a high value resistor connected from the output of said differential power amplifier to its inverting input to provide stability for said differential power amplifier.

7. A high fidelity sound reproducing system comprising:

a dynamic speaker having a given operating frequency range and including a voice coil operatively driving a diaphragm;

a differential power amplifier having an output coupled to the voice coil of said dynamic speaker and a noninverting input connected to an audio signal source for driving said speaker in accordance with an input audio signal;

a measuring transducer associated with said dynamic speaker for generating a first feedback signal proportional to velocity of said dynamic speaker diaphragm; and an active differentiating signal amplifier having an input coupled to said measuring transducer for differentiating the first feedback signal over at least the operating frequency range into a second feedback signal proportional to acceleration of said dynamic speaker diaphragm, said active differential signal amplifier further having an output coupled to an inverting input of said differential power amplifier for feeding the second feedback signal thereto, thereby driving said speaker in accordance with the input audio signal and the second feedback signal, wherein closed loop voltage gain of said differential power amplifier measured form the noninverting input to output is substantially constant over a frequency range from about 10 Hz. to about 40,000 Hz.

8. A high fidelity sound reproducing system comprising:

a dynamic speaker having a given operating frequency range and including a voice coil operatively driving a diaphragm;

a differential power amplifier having an output coupled to the voice coil of said dynamic speaker and a noninverting input connected to an audio signal source for driving said speaker in accordance with an input audio signal;

a measuring transducer associated with said dynamic speaker for generating a first feedback signal proportional to velocity of said dynamic speaker diaphragm; and an active differentiating signal amplifier having an input coupled to said measuring transducer for differentiating the first feedback signal over at least the operating frequency range into a second feedback signal proportional to acceleration of said dynamic speaker diaphragm, said active differential signal amplifier further having an output coupled to an inverting input of said differential power amplifier for feeding the second feedback signal thereto, thereby driving said speaker in accordance with the input audio signal and the second feedback signal, wherein said measuring transducer is positioned in front of said diaphragm.

9. A high fidelity sound reproducing system comprising:

a dynamic speaker having a given operating frequency range and including a voice coil operatively driving a diaphragm;

a differential power amplifier having an output coupled to the voice coil of said dynamic speaker and a noninverting input connected to an audio signal source for driving said speaker in accordance with an input audio signal;

a measuring transducer associated with said dynamic speaker for generating a first feedback signal proportional to velocity of said dynamic speaker diaphragm; and active signal processing means, having an input coupled to said measuring transducer, for phase shifting the first feedback signal by substantially 90° over the operating frequency range and providing a frequency response proportional to frequency to provide a processed feedback signal, said active signal processing means having an output coupled to an inverting input of said differential power amplifier for feeding the processed feedback signal thereto thereby establishing the output signal driving said speaker in accordance with the input audio signal and the processed feedback signal from said active signal processing means.

10. The high fidelity sound reproducing system of claim 9, wherein said active signal processing means comprises an operational amplifier having a noninverting input connected to ground, an inverting input connected through a capacitor to said measuring transducer and a feedback loop including a parallel resistance and capacitance connected between said inverting input and output of said active signal processing means.

11. The high fidelity sound reproducing system of claim 9, wherein said active signal processing means exhibits a gain versus frequency characteristic which is substantially linear and proportional to frequency over a frequency range from about 10 Hz. to about 40,000 Hz.

12. The high fidelity sound reproducing system of claim 9, wherein said active signal processing means imparts a phase shift of substantially 90° to the processed feedback signal with respect to the first feedback signal.

13. The high fidelity sound reproducing system of claim 9, wherein attenuation of the output signal from said active signal processing means with respect to said differential power amplifier output signal is substantially constant over a frequency range from about 10 Hz. to about 40,000 Hz.

14. The high fidelity sound reproducing system of claim 9, including a voltage divider connected at the output of said active signal processing means to attenuate the processed signal from said signal processing means so that the level thereof applied at said inverting input of said differential power amplifier is substantially the same as the level for the input audio signal applied at said noninverting input of said differential power amplifier over a frequency range from about 10 Hz. to about 40,000 Hz.

15. The high fidelity sound reproducing system of claim 9, including a high value resistor connected from said output of said differential power amplifier to said inverting input to provide stability for said differential power amplifier.

16. The high fidelity sound reproducing system of claim 9, wherein closed loop voltage gain of said differential power amplifier measured from the positive input to output is substantially constant over a frequency range from about 10 Hz. to about 40,000 Hz.

17. In a high fidelity sound reproducing system having a plurality of speakers, at least one of said speakers being a dynamic speaker having a given operating frequency range and including a voice coil operatively driving a diaphragm; a differential power amplifier having an output coupled to said voice coil of said dynamic speaker and a noninverting input connected to an audio signal source for driving said speaker in accordance with an input audio signal; a measuring transducer associated with said dynamic speaker for generating a first feedback signal proportional to velocity of said dynamic speaker diaphragm; and an active signal processing means, having an input coupled to said measuring transducer, for phase shifting said first feedback signal, by substantially 90° over the operating frequency range and providing a frequency response proportional to frequency to provide a processed feedback signal, said active signal processing means further having an output coupled to an inverting input of said differential power amplifier for feeding the processed feedback signal thereto thereby establishing the output signal driving said speaker in accordance with the input audio signal and the processed feedback signal from said signal processing means.

18. The high fidelity sound reproducing system of claim 17, wherein said active signal processing means exhibits a gain versus frequency characteristic which is substantially linear and proportional to frequency over a frequency range from about 10 Hz. to about 40,000 Hz.

19. The high fidelity sound reproducing system of claim 17, wherein said active signal processing means imparts a phase shift of substantially 90° to the processed feedback signal with respect to the first feedback signal.

20. The high fidelity sound reproducing system of claim 17, wherein attenuation of the processed feedback signal with respect to said differential power amplifier output signal is substantially constant over a frequency range from about 10 Hz. to about 40,000 Hz.

21. The high fidelity sound reproducing system of claim 17, wherein closed loop voltage gain of said differential power amplifier measured from said noninverting input to output is substantially constant over a frequency range from about 10 Hz. to about 40,000 Hz.

22. In a high fidelity sound reproducing system having a plurality of speakers, at least one of said speakers being a dynamic speaker having a given operating frequency range and including a voice coil operatively driving a diaphragm; a differential power amplifier having an output coupled to said voice coil of said dynamic speaker and a noninverting input connected to an audio signal source for driving said speaker in accordance with an input audio signal; a measuring transducer associated with said dynamic speaker for generating a first feedback signal proportional to velocity of said dynamic speaker diaphragm; and an active differentiating signal amplifier having an input coupled to said measuring transducer for differentiating the first feedback signal over at least the operating frequency range into a second feedback signal proportional to acceleration of said dynamic speaker diaphragm, said active differentiating signal amplifier further having an output coupled to an inverting input of said differential power amplifier for establishing the output signal driving said speaker in accordance with the input audio signal and the second feedback signal, wherein said active differentiating signal amplifier exhibits a gain versus frequency characteristic which is substantially linear and proportional to frequency over a frequency range from about 10 Hz. to about 40,000 Hz.

23. In a high fidelity sound reproducing system having a plurality of speakers, at least one of said speakers being a dynamic speaker having a given operating frequency range and including a voice coil operatively driving a diaphragm; a differential power amplifier having an output coupled to said voice coil of said dynamic speaker and a noninverting input connected to an audio signal source for driving said speaker in accordance with an input audio signal; a measuring transducer associated with said dynamic speaker for generating a first feedback signal proportional to velocity of said dynamic speaker diaphragm; and an active differentiating signal amplifier having an input coupled to said measuring transducer for differentiating the first feedback signal over at least the operating frequency range into a second feedback signal proportional to acceleration of said dynamic speaker diaphragm, said active differentiating signal amplifier further having an output coupled to an inverting input of said differential power amplifier for establishing the output signal driving said speaker in accordance with the input audio signal and the second feedback signal, wherein said active differentiating signal amplifier imparts a phase shift of substantially 90° to the second feedback signal with respect to the first feedback signal.

24. In a high fidelity sound reproducing system having a plurality of speakers, at least one of said speakers being a dynamic speaker having a given operating frequency range and including a voice coil operatively driving a diaphragm; a differential power amplifier having an output coupled to said voice coil of said dynamic speaker and a noninverting input connected to an audio signal source for driving said speaker in accordance with an input audio signal; a measuring transducer associated with said dynamic speaker for generating a first feedback signal proportional to velocity of said dynamic speaker diaphragm; and an active differentiating signal amplifier having an input coupled to said measuring transducer for differentiating the first feedback signal over at least the operating frequency range into a second feedback signal proportional to acceleration of said dynamic speaker diaphragm, said active differentiating signal amplifier further having an output coupled to an inverting input of said differential power amplifier for establishing the output signal driving said speaker in accordance with the input audio signal and the second feedback signal, wherein attenuation of said second feedback signal with respect to said differential power amplifier output signal is substantially constant over a frequency range from about 10 Hz. to about 40,000 Hz.

25. In a high fidelity sound reproducing system having a plurality of speakers, at least one of said speakers being a dynamic speaker having a given operating frequency range and including a voice coil operatively driving a diaphragm; a differential power amplifier having an output coupled to said voice coil of said dynamic speaker and a noninverting input connected to an audio signal source for driving said speaker in accordance with an input audio signal; a measuring transducer associated with said dynamic speaker for generating a first feedback signal proportional to velocity of said dynamic speaker diaphragm; and an active differentiating signal amplifier having an input coupled to said measuring transducer for differentiating the first feedback signal over at least the operating frequency range into a second feedback signal proportional to acceleration of said dynamic speaker diaphragm, said active differentiating signal amplifier further having an output coupled to an inverting input of said differential power amplifier for establishing the output signal driving said speaker in accordance with the input audio signal and the second feedback signal, wherein closed loop voltage gain of said differential power amplifier measured from said noninverting input to output is substantially constant over a frequency range form about 10 Hz. to about 40,000 Hz.

26. A high fidelity stereo sound reproducing system having two channels, each of said channels including:

a respective dynamic speaker having a given operating frequency range and including a respective voice coil operatively driving a respective diaphragm;

a respective differential power amplifier having an output coupled to said respective voice coil of said respective dynamic speaker and a respective noninverting input connected to a respective audio signal source in a respective one of said channels for driving said respective speaker in accordance with a respective input audio signal;

a respective measuring transducer associated with said respective dynamic speaker for generating a respective first feedback signal proportional to velocity of said respective dynamic speaker diaphragm; and a respective active signal processing means, having an input coupled to said respective measuring transducer, for phase shifting the respective first feedback signal by substantially 90° over the operating frequency range and providing a frequency response proportional to frequency to provide a respective processed feedback signal, said respective active signal processing means further having a respective output coupled to an inverting input of said respective differential power amplifier for feeding the respective processed feedback signal thereto thereby establishing the output signal driving said respective speaker in accordance with the respective input audio signal and the respective processed feedback signal from said respective active signal processing means.

27. The high fidelity stereo sound reproducing system of claim 26, wherein each of said active signal processing means exhibits a gain versus frequency characteristic which is substantially linear and proportional to frequency over a frequency range from about 10 Hz. to about 40,000 Hz.

28. The high fidelity stereo sound reproducing system of claim 26, wherein attenuation of the respective processed feedback signal with respect to said respective differential power amplifier output signal is substantially constant over a frequency range from about 10 Hz. to about 40,000 Hz.

29. The high fidelity stereo sound reproducing system of claim 26, wherein closed loop voltage gain of said respective differential power amplifiers measured from said noninverting input to output are substantially constant over a frequency range from about 10 Hz. to about 40,000 Hz.

* * * * *